US007336172B2

(12) United States Patent
Govindaraj

(10) Patent No.: US 7,336,172 B2
(45) Date of Patent: Feb. 26, 2008

(54) SECURITY SYSTEM WITH WIRELESS COMMUNICATION FEATURES

(75) Inventor: Nithyanandhan Govindaraj, Bangalore (IN)

(73) Assignee: Honeywell International Inc., Morristown, NJ (US)

( * ) Notice: Subject to any disclaimer, the term of this patent is extended or adjusted under 35 U.S.C. 154(b) by 93 days.

(21) Appl. No.: 10/998,790

(22) Filed: Nov. 29, 2004

(65) Prior Publication Data

US 2006/0125626 A1 Jun. 15, 2006

(51) Int. Cl.
*G08B 13/00* (2006.01)

(52) U.S. Cl. ..... 340/541; 340/540; 340/506; 340/517; 340/521; 340/531; 340/539.26

(58) Field of Classification Search ..... 340/541, 340/540, 506, 521, 531, 539.1, 539.13, 539.26, 340/539.27, 825.36, 825.49, 825.69, 517, 340/825.72

See application file for complete search history.

(56) References Cited

U.S. PATENT DOCUMENTS 5,892,442 A * 4/1999 Ozery ..... 340/539.14
6,263,050 B1 7/2001 Akhteruzzaman et al.
6,288,643 B1 * 9/2001 Lerg et al. ..... 340/540
6,441,731 B1 * 8/2002 Hess ..... 340/539.26
6,703,930 B2 * 3/2004 Skinner ..... 340/539.11
6,975,220 B1 * 12/2005 Foodman et al. ..... 340/531
7,034,663 B2 * 4/2006 Mansfield et al. ..... 340/538
7,042,353 B2 * 5/2006 Stilp ..... 340/539.22

FOREIGN PATENT DOCUMENTS

WO WO-0167796 9/2001

* cited by examiner

*Primary Examiner*—Hung Nguyen
(74) *Attorney, Agent, or Firm*—Schwegman, Lundberg & Woessner, P.A.

(57) ABSTRACT

Methods and systems are presented to provide wireless features with a property security system. A detected alarm, which is incapable of being communicated externally by the property security system, is passed to a wireless communication device for processing. In response to the alarm, the wireless communication device communicates an emergency message to an emergency call center service via a wireless transmission.

28 Claims, 3 Drawing Sheets

SECURITY SYSTEM WITH WIRELESS COMMUNICATION FEATURES

FIELD

The invention relates generally to security systems and more particularly to security systems with wireless communication features.

BACKGROUND

Property security systems have become pervasive in the world. These security systems protect people and their possession. They may be used by individuals for monitoring their homes or by businesses to monitor their property locations or assets. Security systems detect predefined emergency situations, such as property intrusions, fires, water line breaks, and the like.

Further, wireless communication has become pervasive throughout the world. In response to the availability of wireless communication, governments across the world have levied certain regulations regarding emergency call access. For example, in the United States of America the government now mandates that a 911 call made from a wireless device be handled by a wireless carrier irrespective of whether the individual making that call has an account with that wireless carrier.

Combining wireless communication with security systems has occurred. But, these combinations are not robust and they still necessitate that a user of the security system have a separate wireless account with a wireless carrier in order to enable any wireless features available with the user's security system. Moreover, these security systems generally do not access emergency call centers when activated for wireless communication; rather, the security systems make conventional calls to security monitoring call centers. In addition, the messages communicated to the call centers are not robust and are generally not configurable by the user of the security system.

Therefore, a more robust security system with wireless features is needed.

SUMMARY

In various embodiments, a property security system is augmented with novel wireless features. More specifically, if an alarm is raised that is incapable of being processed by the security system then control is acquired by a wireless communication device. In response to the alarm, the wireless communication device communicates with an emergency call center service and plays an emergency message.

DETAILED DESCRIPTION

Figure 1:
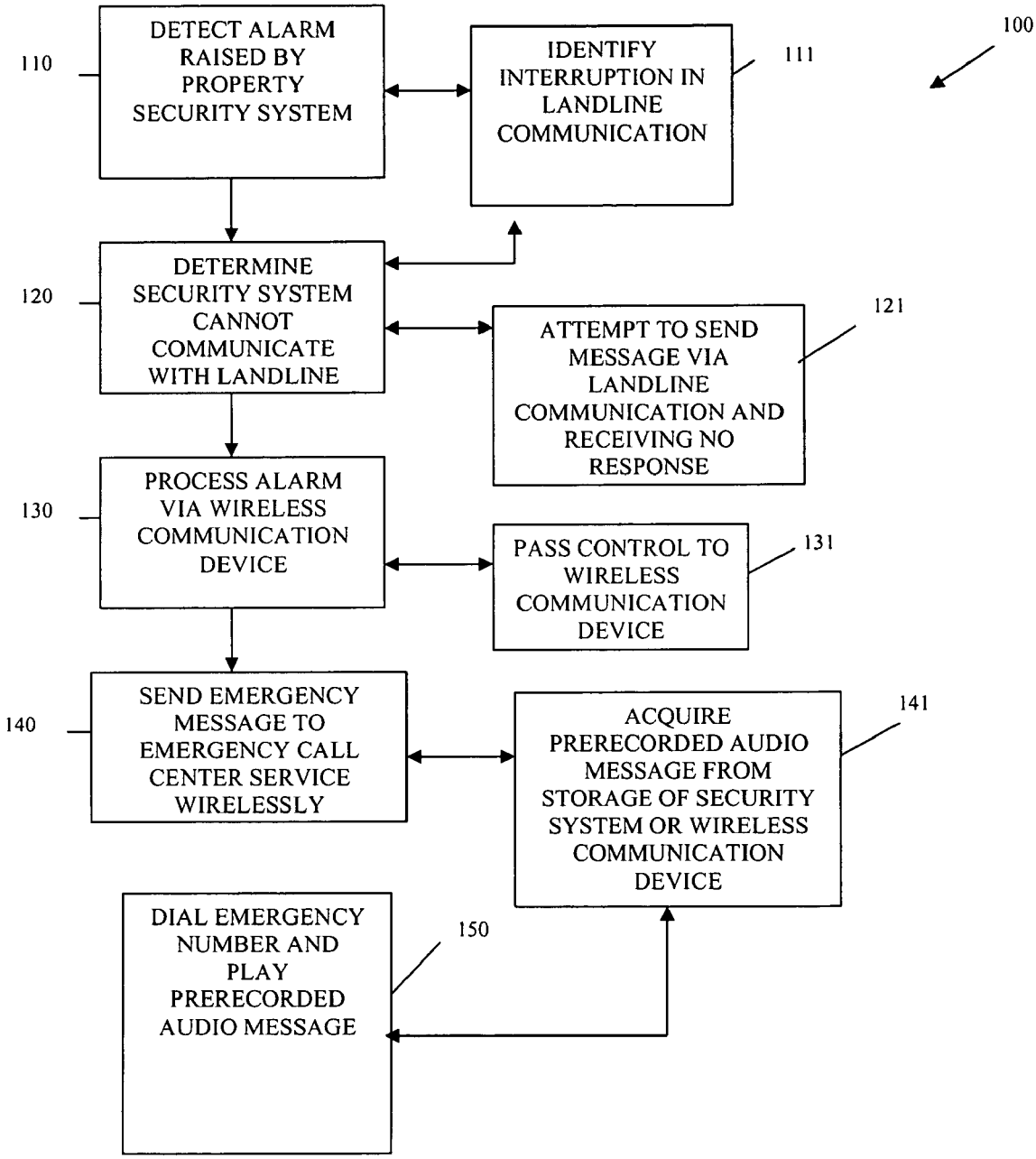
FIG. 1 is a diagram of method for processing an alarm within a property security system, according to an example embodiment.

FIG. 1 is a diagram of method 100 for processing an alarm within a property security system, according to an example embodiment. The method 100 (herein after "wireless service") is implemented in a machine-accessible and readable medium and is accessible over a network. Furthermore, portions of the wireless service are implemented within hardwire and/or firmware/software associated with various aspects of the property security system, which is described herein and below.

In an embodiment, a portion of the wireless service is implemented within the firmware/software of property security system (hereinafter "security system"). This portion passes alarm processing to a wireless communication device, which communicates with the security system. Another portion of the wireless service represents processing implemented in the firmware/software of the wireless communication device; that portion processes an alarm by communicating an emergency message wirelessly to an emergency call center service.

Initially, a security system is configured with the wireless service. In an embodiment, this may entail adding a wireless communication device, such as a wireless transmitter, to augment the hardware and firmware/software of the security system. The configuration may also include storing an emergency number and an emergency message within the security system and/or within the wireless communication device. In addition, the security system may be equipped with a device that stores a variety of emergency numbers; the appropriate emergency number may be automatically selected based on the access or area code associated with a landline communication interfaced to the security system. In an embodiment, the emergency number may be selected based on the geographical property location that houses the security system. Again, this location may be automatically determined based on the area code associated with a landline communication. For example, in the United States of America this emergency number is 911, whereas in other countries this emergency number may be different. Similarly, the emergency message may be preconfigured to audibly play a message and/or to communicate data electronically. Furthermore, the message may be defined and configured by a user of the security system.

At 110, an alarm is detected from the security system. An alarm may be raised within the security system for a variety of reasons, such as a property intrusion, a fire, a water problem, interruption in electrical power, etc. In some cases, alarms may be raised directly by users with remote transmitting devices. For example, a senior citizen may have fallen or injured themselves and be incapable of reaching a phone for communication to an emergency service. In addition, an alarm may be detected based on a phone line (landline) being cut or disconnected. In this manner, at 111, the security system may detect an interruption in the landline's communication, such as when a signal on the landline cannot be detected or abruptly terminates. It may also be the case that the landline is not cut but is not engaged and functioning properly (e.g., unable to get a dial tone on the landline).

At 120, the security system determines that it cannot communicate via a landline (phone) communication service. For example, no signal is present on the phone line or a dial tone is not obtainable. At 121, this determination may be made when the security system attempts to communicate a message over the landline and receives no response or is unable to obtain a dial tone.

At 130, if the landline is unavailable and an alarm is detected, then, the wireless communication device processes the alarm. This can be achieved, at 131, by the security system communicating the alarm to the wireless communication device and passing control processing of the alarm to the wireless communication device.

In response to processing the alarm by the wireless communication device, an emergency message is acquired. The emergency message may be resident in the wireless communication device's memory or storage. Alternatively, the emergency message may be resident in the security system's storage or memory. In still other arrangements, when the security system passes control for processing the alarm to the wireless communication device, the security system may also pass a reference to the location within memory or storage to the wireless communication device, such that the wireless communication device uses the reference to access and acquire the emergency message.

At 140, the wireless communication device sends the emergency message to the emergency call center service via a wireless transmission. The wireless transmission may via a code division multiple access (CDMA) transmission or via a global system for mobile communication (GSM) transmission.

In an embodiment, at 141, the wireless service acquires the emergency message as a user's prerecorded audio message from storage of the wireless communication device or the security system in the manners described above. The prerecorded audio message can be configured and created by the user by accessing a recording device that is interfaced to the security system and/or wireless communication device.

In fact, the audio message may be communicated by a user and acquired by the security system in a variety of manners. For example, a user may use his own telephone or processing device to access a remote service that identifies his/her security system and captures his/her message. For instance, the user may access a World-Wide Web (WWW) site; use a secure sign in to gain access to an automated service; and identify his/her security system and record his/her emergency message. The remote service may then communicate the message directly to the user's security system. In an alternative arrangement, the user performs the same techniques via a telephone to record his/her emergency message. The emergency message may be changed or modified at any time by the user. Thus, the user may change it when he/she is going on vacation or going to be out of town, etc.

At 150, the wireless service completes processing the alarm by dialing or connecting to the emergency call center service and playing the emergency message. An emergency number may be preconfigured within the security system and/or wireless communication device based on the geographical (physical) location of the security system. Alternatively, devices and services within the security system may be used to automatically determine the emergency number based on such things as the access or area code used for landline communication with the security system. Therefore, the emergency number 911 can be preconfigured for security systems located within the United States of America while other countries may use different emergency numbers for security systems within their geographical territories.

It is now understood how a security system may be augmented with the wireless service that represents the processing of the method 100 of FIG. 1. This wireless service provides greater flexibility and security than what has been available in the past because emergency messages may be communicated when alarms are raised even if no wireless service provider is subscribed to by a user. This is so, because most governments now mandate that emergency calls be processed by wireless carriers even when the caller does not have a wireless account. Thus, users can now have wireless security features even when they do not pay a monthly fee to a wireless carrier for a dedicated wireless service. In addition, calls may communicate custom-developed audio messages (emergency messages) made or configured by the user.

In another embodiment, the wireless service may be further augmented in situations where a user has a wireless account with a wireless service provider. In this embodiment, the number may not be an emergency number but rather a number preconfigured by the user. For example, the user may record a message that he/she is out of town and have the message augmented with audio associated with an alarm, such as the word "break in." That is, the wireless service associates alarm conditions with pre-defined audio snippets that can be appended to a user's configured audio message. Thus, if an alarm indicates a "break in" has occurred at the user's property, then another wireless account of the user may be dialed by the wireless service or a neighbor's number dialed and an audio message is played that says, as an example, "this is Nithyanandhan I am out of town and my security system has detected a break in." The neighbor or Nithyanandhan (whomever's number was dialed based on the preconfigured number) may then take steps to confirm or deny that a break in did in fact occur at Nithyanandhan's property.

Figure 2:
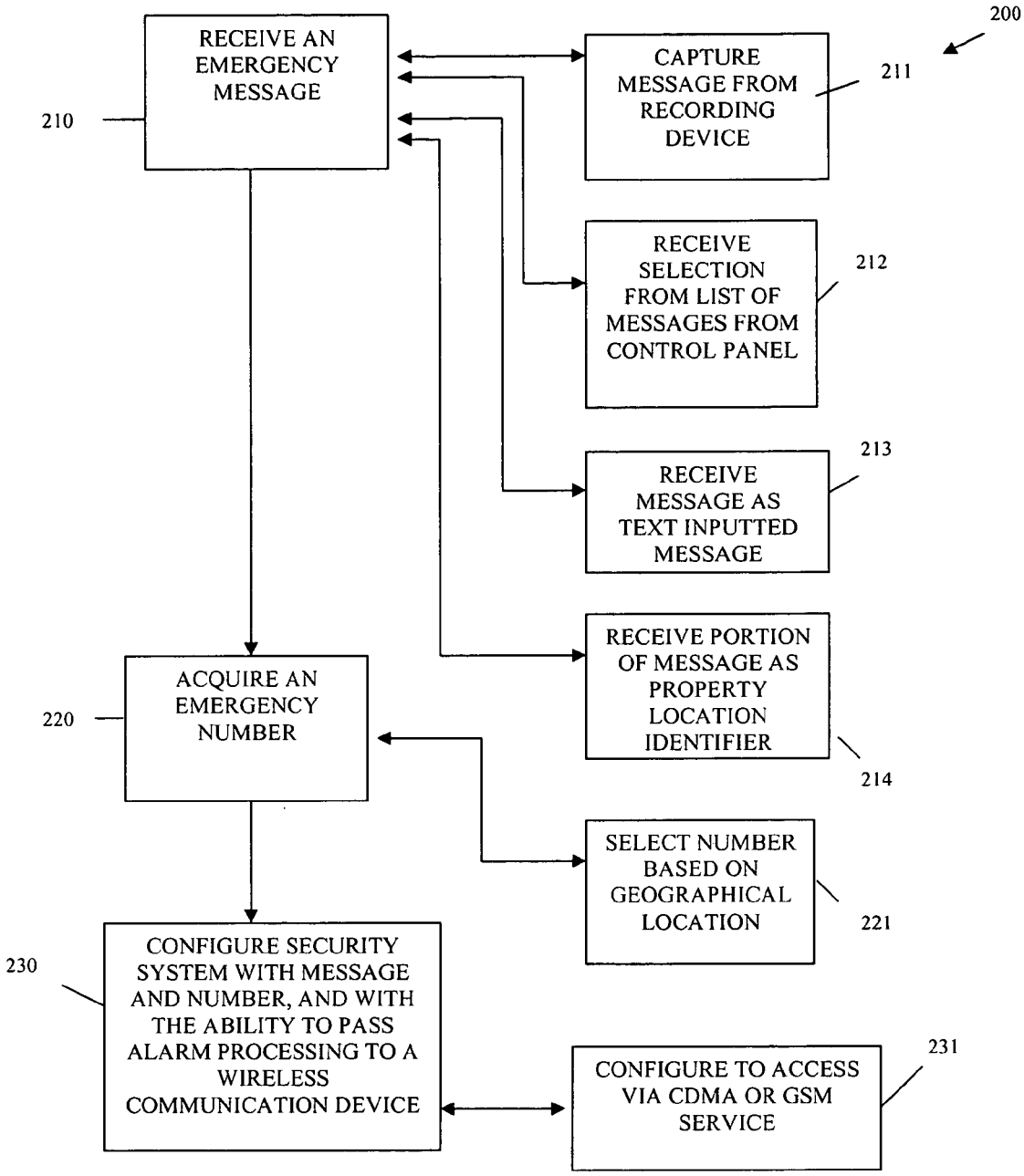
FIG. 2 is a diagram of method for configuring a security system, according to an example embodiment.

FIG. 2 is a diagram of a method 200 for configuring a security system, according to an example embodiment. The method 200 (hereinafter "configuration service") is implemented in a machine-accessible and readable medium. In an embodiment, the configuration service identifies techniques for configuring and initially setting up the processing of the wireless service identified as the method 100 of FIG. 1. Again, the method 200 may be implemented in the firmware/software and hardware associated with a security system. The hardware may include conventional security system hardware augmented with a wireless transmitter or wireless communication device and augmented with the novel processing depicted by the method 200 of FIG. 2.

At 210, the configuration service receives an emergency message. This emergency message is audio although it may be initially communicated as electronic text. Additionally, the emergency message may be augmented, such as when an alarm associated with the security system is mapped to snippets of audio to communicate a specific detected alarm condition associated with the security system. The emergency message may be stored within the security system and/or the wireless communication device. The storage may occur via memory or storage.

In one embodiment, the security system includes a peripheral that accepts removable machine-readable media. Thus, the message may be stored on a removable disk, stick, or cartridge and retrieved by the security system when such a peripheral is available with the security system and/or wireless communication device.

In an embodiment, at 211, the emergency message is captured from a user via a recording device. The recording device may be integrated into a control panel of the security system or may be external to the security device. A variety of mechanisms may be used in instances where the recording device is external to the security system. For example, the user may use a phone or a WWW site to communicate the emergency message via an automated service. The automated service may then communicate the emergency message to the security system.

In another embodiment, at 212, the emergency message may be selected from a list of available predefined emergency messages. Moreover, messages may be beneficially classified into groups, such as one message for fire, one message for emergency medical help, one message for a potential break in, etc. For example, the security system may include a control panel with a display where a user interacts with the control panel and the display to view, perhaps listen to, and ultimately to select a desired emergency message. In some cases, the list may be preconfigured and recorded by the user, such that each message in the list or one or more messages in the list are recording made by the user. In an alternative embodiment, the user accesses the list of available emergency messages from an automated phone service or WWW service; such that when a user selection is made, it can be communicated from the automated service to the security system.

In still another embodiment, at 213, the security system may be equipped to translate text to audio and vice versa, such that a user may input a text string into the security system in order to provide the emergency message. Again, in some cases, the text to audio service does not have to reside within the security system, such as when the user accesses an automated WWW service and accesses a portion of the WWW service that provides text to audio translations and then communicates the audio message as the emergency message to the security system.

In another embodiment, at 214, the emergency message may include a portion of its message that identifies the geographical location of the security system. For example, this is Nithyanandhan's home located at 110 Honeywell Street, Bangalore, India.

Again, some portions of the emergency message may be supplied by a user while other portions of the emergency message are automatically and dynamically constructed by the security system and/or wireless communication device during operation. For example, alarm codes may map to audio snippets, such as fire, flood, break in, etc. A user may also have prerecorded the user's name. Thus, an entire emergency message may be assembled dynamically to form a complete audio message that is ultimately communicated to an emergency call center service when needed.

As an example, assume that the user is Nithyanandhan and he prerecords his name and then provides a current emergency message that states "I am out of town please call my friend Joe at 888-000-0000." During operation of the security system suppose that an alarm indicates a potential fire has occurred at Nithyanandhan's home geographically located at 110 Honeywell Street, Bangalore, India. Suppose further that during the fire at Nithyanandhan's home that the phone line was damaged or disabled by the fire. In this example, the security system will wireless communicate to an emergency call center service, the following audible message: "This is Nithyanandhan, I am out of town please call my friend Joe at 888-000-0000, a fire has been detected at 110 Honeywell Street, Bangalore, India."

Continuing with the configuration service's processing description at 220, a default emergency number is acquired for the security system. The emergency number is acquired based on the geographical location of the security system. Thus, a single security system may have a variety of emergency numbers that can change based on the physical location of where the security system is installed. For example, in the Unites States of America, security systems are associated with the emergency number 911. For other geographic locations other emergency numbers may be used.

At 230, the security system is configured with the emergency message and the emergency number. Additionally, the security system is instructed to pass processing control for communicating the emergency message to a wireless communication device interfaced to the security system when it is determined that a landline communication mechanism is unavailable. This ensures that the emergency message is communicated to an emergency call center service at the emergency number when the landline interfaced to the security system is unavailable and when the security system has detected an alarm situation.

At 231, the wireless communication device may utilize either CDMA or GSM transmissions to wirelessly connect to the emergency number and to play the emergency message for the emergency call center service. CDMA is popular in the United States of America whereas GSM is pervasive throughout the rest of the world. Additionally, the United States of America has recently begun migrating towards GSM coverage. Thus, the security system may select between CDMA and GSM based on its geographic location.

The configuration service that represents the method 200 of FIG. 2 illustrates a variety of techniques for configuring a security system with novel wireless features. The operation of the configured security system was discussed above with respect to the wireless service represented by the method 100 of FIG. 1.

Figure 3:
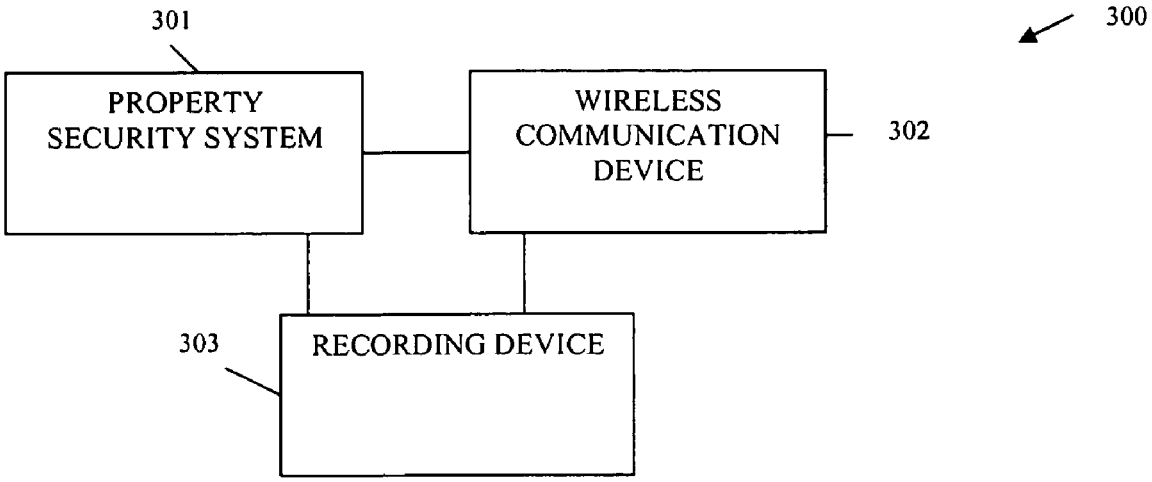
FIG. 3 is a diagram of a security system, according to an example embodiment.

FIG. 3 is a diagram of a security system 300, according to an example embodiment. The security system 300 is implemented in a variety of hardware and firmware/software, which is integrated into the hardware. The security system 300 may be configured with the processing of the method 200 of FIG. 2. Additionally, the security system 300 performs, among other things, the processing of the method 100 of FIG. 1.

The security system 300 includes a property security system 301 and a wireless communication device 302. The security system 300 may also include a recording device 303.

The property security system 301 may include any conventional hardware and firmware/software which is modified in a novel manner to interface with the wireless communication device 302. The wireless communication device 302 is a wireless transmitter and wireless stack attached to the panel hardware.

The property security system 301 also includes a variety of sensors to detect a variety of physical events occurring at a geographical location where the security system 300 is installed. For examples, sensors may detect when a window is broken, a door is breached, movement is noticed, smoke is sensed, landline communication (phone line) failed, water is detected, etc. When the sensor reports an alarm condition to the firmware/software of the property security system 301, then the property security system 301 attempts to communicate an emergency message to an emergency call center service over a landline (phone line). However, if the landline is non operational, then the property security system 301 passes the alarm to the wireless communication device 302.

The wireless communication device 302 then wirelessly connects to an emergency call center service located at a predefined emergency number and once connected plays a predefined or dynamically assembled emergency message. The wireless transmission may be made using CDMA or GSM. Additionally, the emergency message and emergency number may be obtained, constructed, and/or assembled in the manners described above with the configuration service represented by method 200 of FIG. 2.

In an embodiment, the security system 300 also includes a recording device 303. The recording device 303 may be interfaced to the property security system 301 and/or the wireless communication device 302. The recording device 303 is used to capture all or some portion of the emergency message. The emergency message may be stored within the local environment of the property security system 301 and/or the wireless communication device 302. In an embodiment, the property security system 301 and/or wireless communication device 302 also includes a removable media peripheral port, such that all or a portion of the emergency message is retrieved from removable machine-readable media interfaced or inserted into the port.

The property security system 301 is adapted to pass alarm processing control to the wireless communication device 302 when a landline communication is unavailable and when an alarm has been detected by one or more of the sensors of the property security system 301. The wireless communication device 302 is adapted to process the alarm by acquiring and/or assembling the appropriate emergency message, by acquiring the emergency number, and by connected to an emergency call center service via the emergency number to play the emergency message.

In an embodiment, the wireless communication device 302 is also adapted to wirelessly play the emergency message for the emergency call center service when it detects that it can no longer communicate with the property security system 301. This may occur when an intruder attempts to disable the property security system by cutting its power line and/or removing its battery backup. The wireless communication device 302 may have its own separate and independent batter source, such that any attempt to disable the property security system 301 raises an alarm within the wireless communication device 302 which drives it to play the emergency message to the emergency call center service.

Figure 4:
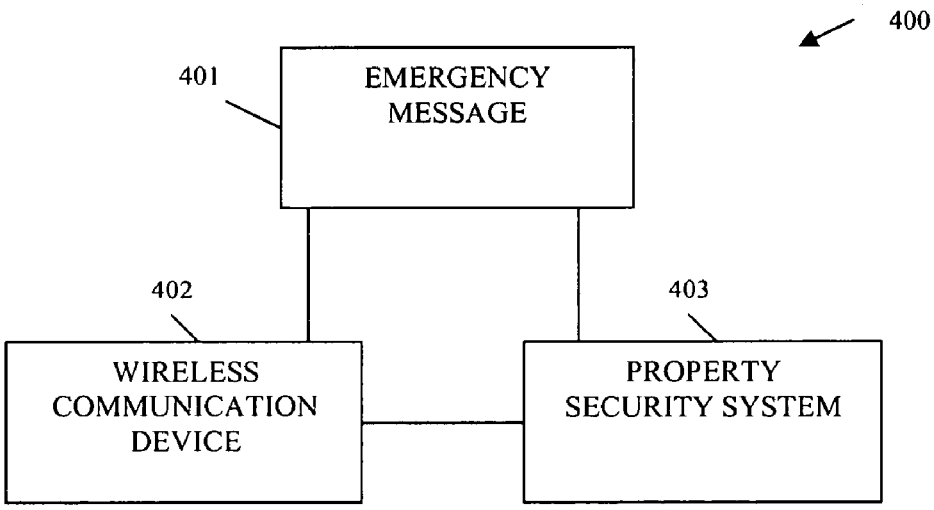
FIG. 4 is a diagram another security system, according to an example embodiment.

FIG. 4 is a diagram of another security system 400, according to an example embodiment. The security system 400 is implemented in a variety of hardware and firmware/software, which is integrated into the hardware. FIG. 4 presents an alternative view to the security system 300 of FIG. 3. The security system 400 may be configured by the method 200 of FIG. 2 and during operation performs, among other things, the processing of the method 100 of FIG. 1.

The security system 400 includes an emergency message 401 and a wireless communication device 402. The wireless communication device 402 is interfaced to a property security system 401.

The emergency message 401 resides in machine-readable medium. The emergency message 401 may be wholly predefined and available from memory or storage associated with the property security system 403 and/or the wireless device 402. Alternatively, the emergency message 401 may be dynamically assembled from a variety of disparate locations and/or from a variety of processing associated with the property security system 403 and/or the wireless communication device 402.

In an embodiment, the emergency message 401 is changeable by a user of the property security system 403. In another embodiment, the emergency message is predefined within the property security system 403. The configuration of the emergency message 401 and its dynamic construction, if applicable, may occur in the variety of manners described above with the method 200 of FIG. 2.

The wireless communication device 402 is adapted to dynamically acquire and/or assemble the emergency message when an alarm is passed to it from the property security system 403. In response to the alarm, the wireless communication device 402 is also adapted to acquire an emergency number which is used to connect to an emergency call center service, at which point the emergency message is played for the emergency call center service.

In one embodiment, the alarm occurs when a landline communication becomes unavailable or is disrupted. This event is detected by sensors and/or processing associated with the property security system 403. For example a sensor may detect that a landline (phone line) has been cut. Alternatively, processing may attempt to use the landline during a different alarm situation and discover that the landline is not available for use. When an alarm is detected and when the landline is unavailable, processing is passed or actively assumed by the wireless communication device 402.

In another embodiment, the wireless communication device 402 may independently assume control and raise its own alarm when it detects that communication with the property security system 402 is disrupted. In this manner, the wireless communication device 402 may include at least one sensor or set of processing logic that is adapted to detect when communication between the wireless communication device 402 and the property security system 403 is disrupted.

In still other embodiments, the wireless communication device 402 may regularly and at predefined intervals make reattempts to communicate the emergency message 401 with the emergency call center service. This may be useful when prior attempts to communicate the emergency message 401 resulted in line drops, interferences, or other types of communication failures, such that the wireless communication device 402 was not able to assure itself that the emergency message 401 was successfully communicated to the emergency call center service.

It has now been demonstrated how a security system may be augmented with novel wireless features. These features are integrated into the security system with wireless devices and with a variety of firmware/software. The processing associated with the firmware/software permits flexible emergency messages to be defined or dynamically assembled and an appropriate emergency number acquired. Additionally, when landline communication is unavailable alarms are processed by the wireless device by connecting to an emergency call center service via the emergency number and by playing the emergency message. This adds an additional level of redundancy and provides piece of mind for users of the security systems. Moreover, it may be implemented within security systems that do not carry wireless service accounts, since governments have now generally require that emergency numbers be serviced by wireless carriers even in the absence of wireless accounts.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A method, comprising:

detecting that a property security system has raised an alarm;

determining that the property security system is incapable of communicating the alarm through a landline communication service;

processing the alarm via a wireless communication device; and playing a message for an emergency call center service via the wireless communication device, wherein the message is a voice recorded message custom provided by a user, and wherein the message is acquired from the user via one or more of the following a phone, a processing device interfaced to the property security system, and a World-Wide Web (WWW) Internet connection, and wherein the message is selected from a list of available messages and classified in response to the alarm being associated with one or more of the following: a break-in, a fire, and a medical help situation, and wherein at least a portion of the message is augmented with an audio snippet automatically and dynamically supplied by the property security system in response to the alarm, the message and the audio snippet assembled dynamically to form a complete audio message that is played as the message for the emergency call center service via the wireless communication device.

2. The method of claim 1, wherein detecting further includes identifying an interruption in service on a landline for the landline communication service indicating that the landline has been cut or disconnected.

3. The method of claim 1, wherein determining further includes attempting to communicate the message via the landline communication service and receiving no response indicating that the security system is incapable of communicating the message though the landline communication service.

4. The method of claim 1, wherein processing further includes passing control of processing the alarm to the wireless communication device, which is associated with the security system.

5. The method of claim 1, wherein sending further includes acquiring a prerecorded audio message as the message from within storage of the security system or the wireless communication device.

6. The method of claim 5, wherein sending further includes dialing an emergency number and once connected to the emergency call center service playing the prerecorded audio message.

7. A method, comprising:

receiving an emergency message, wherein the emergency message is at least partially customized by a user and includes a voice recorded message, and the emergency message is select from a list of available messages in response to an alarm being classified as one or more of the following: a break-in, a fire, and a medical help situation, and wherein another portion of the emergency message is an audio snippet automatically and dynamically constructed by a security system, the customized portion and the audio snippet dynamically assembled to form the emergency message;

acquiring an emergency number; and configuring the security system to connect to an emergency call center service accessed through the emergency number to play the message via a wireless communication if the alarm is detect and the security system is incapable of communicating the emergency message via a landline communication service.

8. The method of claim 7, wherein receiving further includes capturing the message from a recording device interfaced to the security system which is accessed by a user, wherein the message is audibly communicated by the user to the recording device.

9. The method of claim 7, wherein receiving further includes receiving a selection from a user interfaced to a control panel of the security system, wherein the selection identifies the message from a selection of available messages.

10. The method of claim 7, wherein receiving further includes receiving the message as a text inputted string supplied by a user interfaced to a control panel of the security system.

11. The method of claim 7, wherein the receiving further includes receiving a portion of the message as a location identifier that identifies a property location associated with the security system.

12. The method of claim 7, wherein configuring further includes accessing the wireless communication service via at least one of a code division multiple access (CDMA) transmission and a global system for mobile communication (GSM) service.

13. The method of claim 7, wherein acquiring further includes selecting the emergency call center number from a list of available emergency call center numbers based on a geographical location associated with the security system.

14. A system, comprising:

a property security system; and a wireless communication device interfaced to the security system, wherein the security system is adapted to pass processing control to the wireless communication system when a landline communication device is unavailable for use by the security system, and wherein the wireless communication device is adapted to connect wirelessly to an emergency call center service when control is passed and play an audible emergency message, and wherein that emergency message was at least partially and previously custom defined by a user and the emergency message includes a voice recorded message, and wherein the message is selected from a list of available messages and in response to an alarm being raised and classified as one or more of the following: a break-in, a fire, and a medical help situation, and wherein a portion of the audible emergency message is dynamically constructed as an audio snippet dynamically constructed by the property security system in response to the alarm and the property security system dynamically assembles the user supplied portion of the message and the audio snippet to form a complete audio message as the audible emergency message that is played for the emergency call center service.

15. The system of claim 14 further comprising, a recording device interfaced to the security system for receiving the emergency message.

16. The system of claim 14, wherein the wireless communication device is also adapted to acquire processing control when the security system fails and is further adapted to connect wirelessly to the emergency call center service and play the emergency message.

17. The system of claim 14, wherein the wireless communication device connects to the emergency call center service using at least one of a code division multiple access (CDMA) transmission and a global system for mobile communication (GSM) service.

18. The system of claim 14, wherein the wireless communication device accesses a preconfigured emergency number to connect to the emergency call center service.

19. The system of claim 14, wherein the emergency message is configurable by a user.

20. The system of claim 14, wherein the emergency message is stored in at least one the security system and the wireless communication device.

21. A system, comprising:

an emergency message, wherein the emergency message is at least partially defined by a user and includes a voice recorded message, and wherein the emergency message is classified in response to whether it is associated with one or more of the following: a break-in, a fire, and a medical help situation, and wherein another portion of the emergency message is automatically and dynamically constructed by a property security system in response to an alarm, and the property security system dynamically assembles the emergency message as a complete audio message have the voice recorded message and the audio snippet; and a wireless communication device, wherein the emergency message is acquired by the wireless communication device when the alarm is detected with the property security system, and wherein the wireless communication device is adapted to play the emergency message for an emergency call center service if the property security system of incapable of externally communicating the emergency message to the emergency call center service.

22. The system of claim 21, wherein the emergency message is predefined based on an initial configuration of the property security system.

23. The system of claim 21, wherein the emergency message is configured by a user of the property security system.

24. The system of claim 21, wherein the emergency message is stored within the wireless communication device.

25. The system of claim 21, wherein the emergency message is stored within the property security system.

26. The system of claim 21, wherein the alarm is raised automatically by the property security system when a landline communication service interfaced to the property security system fails.

27. The system of claim 21, wherein the alarm is detected when the wireless communication device detects that communication between the property security system and the wireless communication device fails.

28. The system of claim 21, wherein the wireless communication device is adapted to regularly reattempt to communicate the emergency message to the emergency call center service if some type of interruption or failure occurred with prior attempts.

* * * * *